United States Patent [19]

Lamontagne et al.

[11] 4,212,591

[45] Jul. 15, 1980

[54] PRESSURE CONTROL FOR PUMPS

[75] Inventors: Robert E. Lamontagne, Boulder; Jon V. Scull, Longmont, both of Colo.

[73] Assignee: Binks Manufacturing Company, Franklin Park, Ill. ; Croyle; Carlton R.

[21] Appl. No.: 932,520

[22] Filed: Aug. 10, 1978

[51] Int. Cl.[2] ..... F04B 49/08

[52] U.S. Cl. ..... 417/38; 200/81.9 R; 200/83 B; 417/223

[58] Field of Search ..... 417/36, 37, 38, 44, 417/223; 200/81.9 R, 81.9 M, 81.9 HG, 82 C, 83 Z, 83 B

[56] References Cited

U.S. PATENT DOCUMENTS

| | | | |
|---|---|---|---|
| 1,098,173 | 5/1914 | Ruff | 417/44 X |
| 2,514,361 | 7/1950 | Baker | 417/38 X |
| 2,885,506 | 5/1959 | Anderson | 200/83 B |
| 2,953,659 | 9/1960 | Edwards | 200/81.9 R |
| 3,424,883 | 1/1969 | Heskett | 417/38 |
| 3,446,238 | 5/1969 | Norstrud et al. | 417/44 X |
| 3,738,775 | 6/1973 | Strickland | 417/38 |
| 4,051,338 | 9/1977 | Harris | 200/82 C |

*Primary Examiner*—Carlton Croyle
*Assistant Examiner*—Edward Look
*Attorney, Agent, or Firm*—Gary, Juettner & Pyle

[57] ABSTRACT

An adjustable pressure control device relies on the change of shape or position of a control hose portion responsive to internal pressure of fluid being transmitted therethrough to control the fluid pressure produced by a pump. One embodiment of the device utilizes a short piece of high pressure hose in the fluid line which is adjustably deformed. As pressure builds up in the hose, the hose tends to return to its original shape, thereby actuating a suitable control instrumentality for the pump, such as an electric switch which opens the circuit to an electric clutch or to an electric drive motor for the pump, thereby temporarily stopping the pumping action. Another embodiment, to accomplish the same function, relies on the change of the arcuate position of a control hose due to variations in fluid pressure therein.

5 Claims, 4 Drawing Figures

PRESSURE CONTROL FOR PUMPS

BACKGROUND OF THE INVENTION

This invention relates to a device for controlling the fluid pressure in the output line of a high pressure pump utilized, for example, in hydraulic spraying of paint or other liquid coating materials.

In a typical operation, coating material is supplied at high pressure in the order of about 1,000 to 3,000 p.s.i. to an atomizing nozzle having an elliptical orifice forming a fan-shaped spray. Spray coating is conventionally an intermittent operation and, for this reason, a manually operated valve is associated with the nozzle to accommodate starting and stopping of the spray. Means must also be provided to control the fluid pressure at the spray tip because such pressure must be fairly constant even though the spray gun is operated intermittently. Thus, the fluid pressure at the outlet of the pump must be quite accurately controlled.

One prior art device for controlling output pressure comprises a spring loaded plunger which, responsive to pressure variations, opens and closes the contacts of a pump controlling switch. Such a device requires seals, such as O-rings, which get gummed up and wear out quickly. Furthermore, a dead end pocket may be created wherein the coating material can harden and eventually clog the system and disable the control.

Other prior art control devices, such as disclosed in U.S. Pat. Nos. 2,390,643; 2,823,543; 3,569,647 and 3,711,828, utilize a bourdon tube, the free end of which opens or closes a switch in response to variations in fluid pressures, the switch in turn controlling pump operation. Bourdon tube devices, however, are comparatively expensive and, at times, difficult to adjust. Furthermore, the bourdon tubes do not transmit fluid therethrough and therefore are not self-cleaning but, instead, are subject to inaccuracies in those instances when fluids such as paint are utilized in the system.

Still other devices, such as disclosed in U.S. Pat. Nos. 1,169,692 and 2,471,838, utilize systems of bellows to control fluid pressure, the bellows being closed at one end and therefore being subject to the same disadvantages as the bourdon tube devices when the fluid involved is paint or the like.

SUMMARY OF THE INVENTION

An object of this invention is to provide a device for controlling the fluid pressure in the output line of a pump, the device requiring no fluid seals and being comparatively simple and inexpensive.

Another object is the provision of a device for controlling pump output line pressure, while accommodating continuous through-flow and constant purging, this being particularly important when pumping paint or other similar coating materials.

Briefly, the invention contemplates controlled deformation of a short length of high pressure hose incorporated in the outlet line of a fluid pump. Deformation of the hose may be accomplished by means of spring biased hose compressor member so that variations in pressure vary the amount of deformation of the hose, whereby a pump controlling device such as a switch can be operated to stop and start the pump as a function of output pressure.

Alternately, a hose which increases in length with increases in fluid pressure is arcuately deformed and a switch means senses variations in the arc of the hose.

DETAILED DESCRIPTION OF A PREFERRED EMBODIMENT

Figure 1:
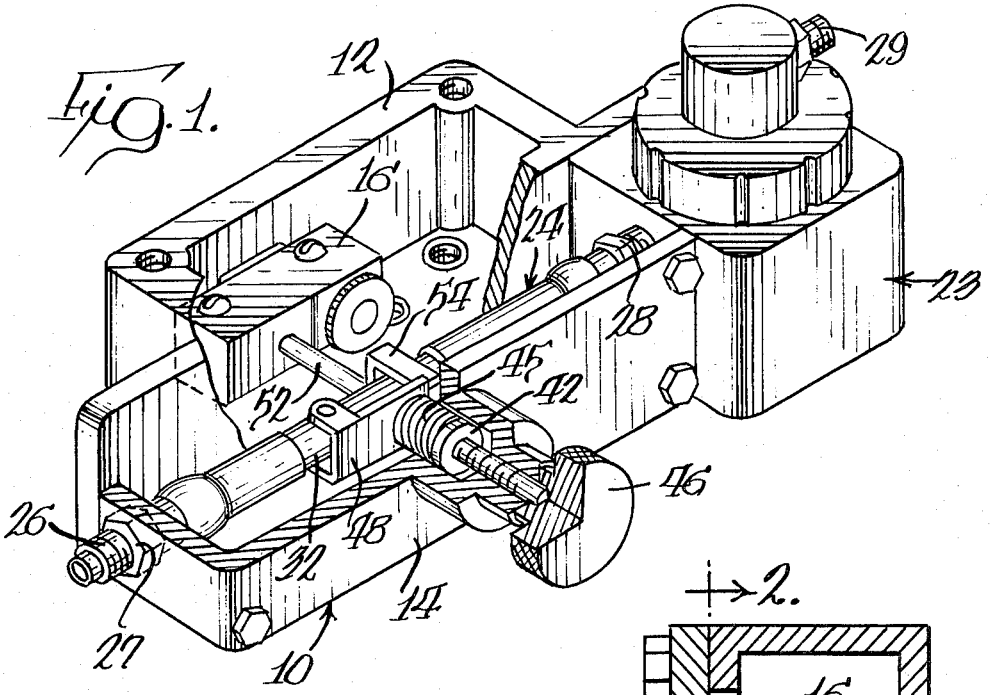
FIG. 1 is a perspective view of the control device of the present invention with portions broken away to reveal the inner structure.

Referring to the drawings, the pressure control device is mounted in a two-piece housing, indicated generally at 10, which comprises a switch box portion 12 and a control mounting portion 14. In the preferred embodiment, switch means, preferably in the form of a microswitch 16, is mounted in housing portion 12 and controls the electrical power supply circuit for an electric drive motor for a pump, or an electric clutch interposed between a motor and a pump. A representative motor, clutch and pump are indicated schematically at 18, 19 and 20, respectively.

In a basic operation, the pump 20 supplies a fluid, such as a liquid coating material or paint, through a flexible hose indicated diagramatically at 22 to a point to use, for example, to a spray gun (not shown). The coating material is generally supplied at high pressures in the order of about one thousand to three thousand p.s.i. to an atomizing nozzle in the spray gun. Because spray painting is basically an intermittent operation, means must be provided to control the fluid pressure in the line. For example, each time the gun is shut off, the line pressure increases beyond a desired maximum unless the pump is stopped when that maximum is reached. Conversely, starting the spray gun drops the pressure in the line and the pump must once again be activated to maintain at least a desired minimum pressure. This control over the pump is achieved by switch means 16, the contacts of which are opened and closed by the control device of the present invention. The switch means may control a clutch interposed between the motor and the pump but, in the preferred embodiment, controls the motor directly.

Figure 3:
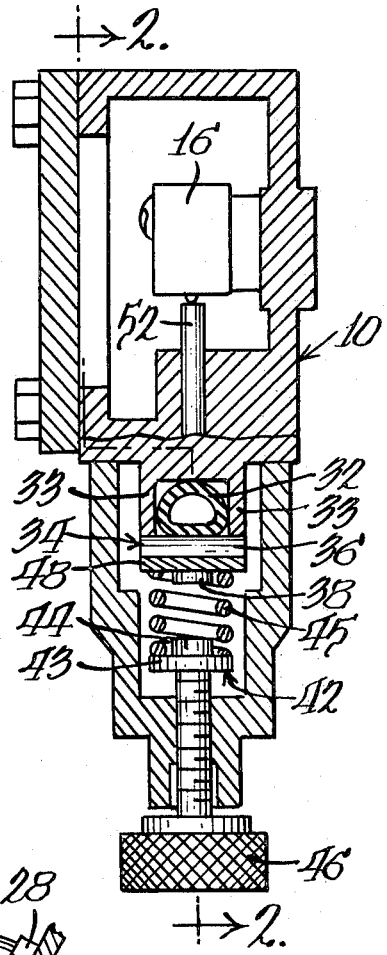
FIG. 3 is a vertical sectional view taken substantially along section line 3—3 of FIG. 2.
Figure 2:
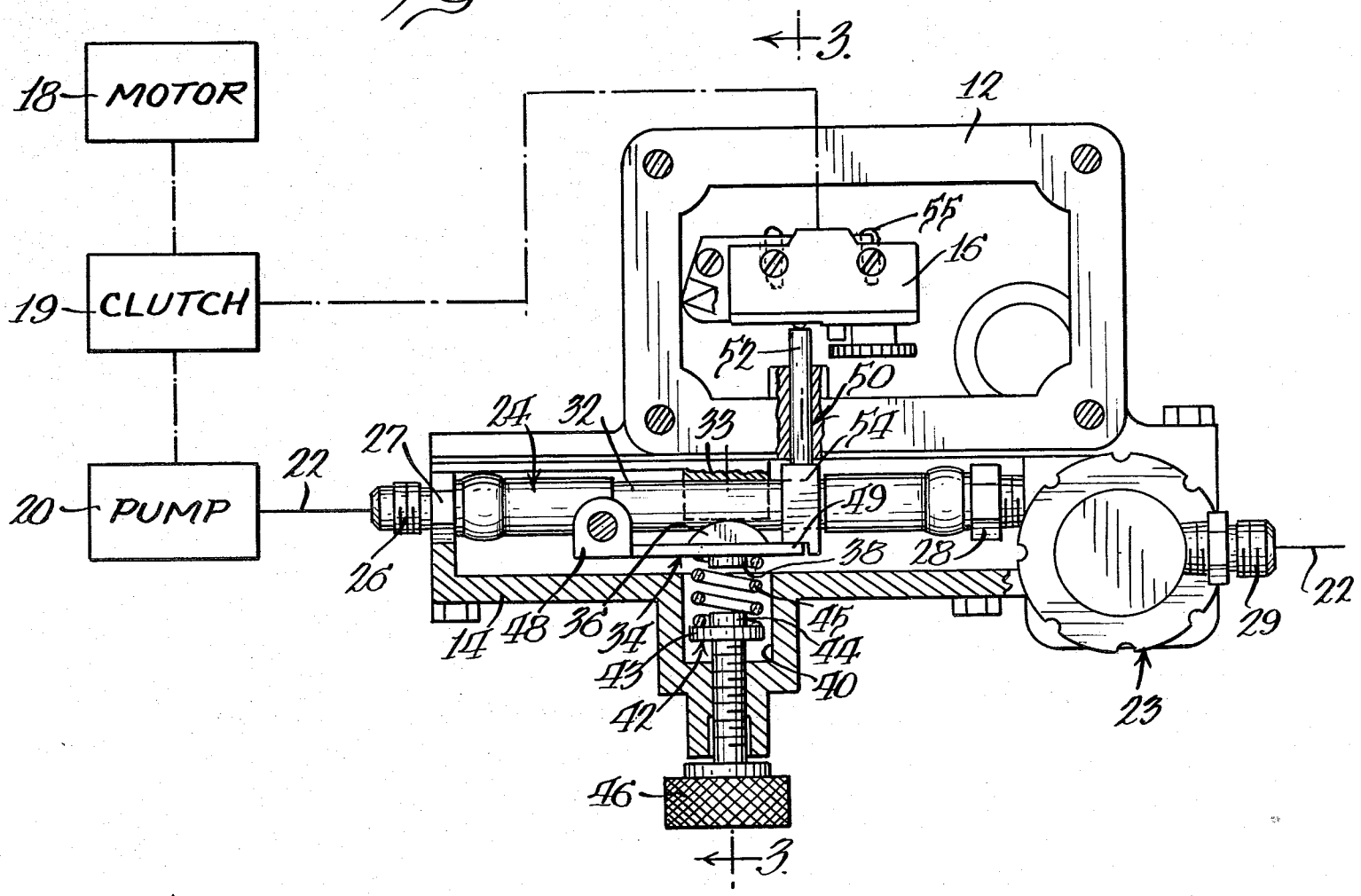
FIG. 2 is a horizontal sectional view taken substantially along section line 2—2 of FIG. 3.

The device of the invention as seen in the embodiment of FIGS. 1–3, is characterized by a comparatively short length of control hose 24, the inner end of which is mounted in the housing portion 14 by means of an adapter 28 threaded into the outlet end of the housing or, as shown in the present embodiment, to a filter 23 incorporated in the housing. The opposite or inlet end of the hose is similarly provided with an adapter 26 which is slidably but non-rotatably mounted in the housing 14 by the expedient of sliding the conventional hex wrench surface 27 on the adapter into a correspondingly shaped opening in the housing. The control hose 24 in thus firmly mounted in the housing but with freedom for longitudinal expansion and contraction. The fluid outlet of the pump 20 is coupled with the adapter 26 and the filter 23 has an outlet 29 to which a flexible hose 22 leading to a spray gun may be connected. The control hose 24 thus forms part of the fluid outlet line from the pump and is directly exposed to the fluid flow and fluid pressure in the line. Between the adapters is an exposed portion 32 of the control hose. If desired, spaced lugs 33 may be provided on the inner housing wall to prevent lateral movement and to hold the hose portion 32 centered in the housing as best seen in FIG. 3 so as to prevent the hose from being excessively deformed and damaged.

The control hose portion 32 is arranged to be deformed, as seen in FIGS. 2 and 3, by a hose compressor or plunger 34 preferably formed with an arcuately convex head 36. The plunger also includes a projecting boss 38. Received in an opening 40 in housing portion 14 is a spring guide 42 having a shoulder portion 43 and an extending boss 44. Resilient means 45, preferably in the form of a compression spring, is received in the opening 40 between the plunger 34 and the spring guide 42 and is held in position by the bosses 38 and 44. An adjusting means 46 is threadably received in housing portion 14 and bears against the spring guide 42 so that the plunger 34 is spring biased or resiliently urged against the control hose portion 32 to deform the hose portion as seen in FIG. 3. The amount of deformation, which is adjustable by means 46, may vary depending on the material being sprayed, the pump pressures desired, and other variables.

In the preferred embodiment, a lever 48 is pivotably mounted to the housing and is restrained between the plunger head 36 and the spring 45 for movement therewith. The free end 49 of the lever 48 is engageable with a switch actuating means indicated generally at 50. In its preferred form, the switch actuating means 50 comprises a body 52 perpendicular to the longitudinal axis of the control hose 32 and is provided at its ends with a U-shaped portion 54 straddling the control hose. The lever, if desired, could be replaced by an arm extending from the plunger 34 but the lever is preferred because of the ability of such a device to vary the proportional movement of the parts. Preferably, the switch contacts are normally open but are held closed, when the pump is operating at the intended or preselected pressure, by the lever 48 acting through actuating means 50.

During the spraying operation, the pressure of the fluid flowing from the pump to the spray nozzle remains fairly constant. However, each time that the gun is shut off, the pressure in the line increases and this increases in pressure causes the deformed control hose position to attempt to regain its normally circular form or, in other words, to move from a predetermined position which is inconsistent with the position the hose assumes or attempts to assume when subjected to increase in pressure. This action moves the plunger 34 in a direction away from the control hose against the force of the spring 45 and also pivots the lever 48 away from the switch means. This movement of the lever, which is operatively engaged with the actuating means 50, releases the holding pressure of the actuating means and permits the contacts of the microswitch 16 to open, breaking the circuit to the motor 18 or the clutch 19 and stopping the pump. When the spraying operation is again initiated, the pressure in the hose drops and the hose deforms to its predetermined deformed position by virtue of the spring 45 acting against plunger 34. The movement of the plunger moves lever 48 and actuating means 50 to a position closing the switch contacts to start the pump.

Figure 4:
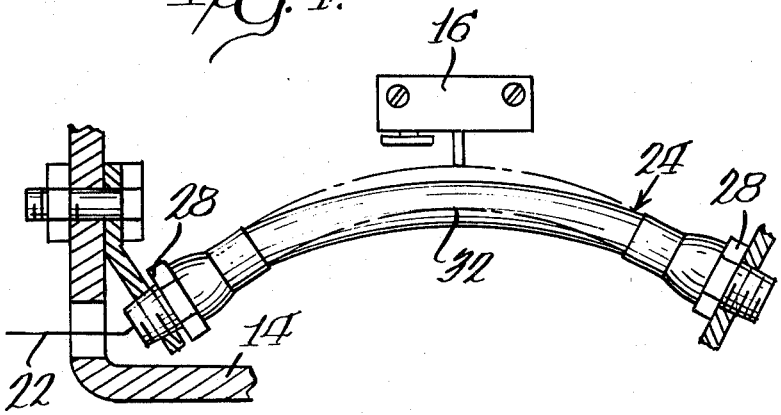
FIG. 4 is a fragementary view of an alternate embodiment of a control hose which may be utilized in the present invention.

An alternate embodiment of the control hose 24 having an exposed portion 32 is shown in FIG. 4. In this embodiment, both ends of the hose are provided with adapters 28, one of which may be threaded into the housing, or into a bracket secured to the housing, while the other may be threaded into a filter, as in the embodiment of FIG. 1. The hose is deformed into an arcuate configuration as shown by the solids lines, this configuration representing an adjustably predetermined position at decreased pressure. When the internal fluid pressure increases, the tube length increases whereby the arc of the tube moves to the position shown by the dotted lines in FIG. 4 to actuate the switch means 16 and thereby control the pump. A typical hose which may be utilized for this purpose is a braided high pressure, nylon lined, airless spray hose although other types of hose having the desired characteristic may be used. It will be apparent that such a hose could be installed without an arc of curvature, and the change in length be utlized to control the switch means. However, this arrangement would require positioning the various elements to fairly exact dimensions. Use of the arcuate configuration, on the other hand, permits the use of wider tolerances without any sacrifice in performance characteristics.

It may also be desirable, both in the embodiment of FIG. 4 and the embodiment of FIGS. 1–3, to provide switch mounting slots 55 in the switch box portion 12 of the housing 10, as shown in FIG. 2, so that the position of the switch may be altered to adjust the pressure at which it will be actuated. Thus, the switch may be moved toward or away from the control hose to effect pressure adjustment or as a means of setting the desired maximum pressure.

The device described herein is much simplier and much less costly than prior art devices. Furthermore, the device provides for continuous flow and constant purging of the fluid lines. Another advantage of the present arrangement is that there are no dead end pockets in which material can gather and dry out, thereby lowering the efficiency and at times stopping the operation completely until the dried out material is cleaned from the system. The system described herein is also advantageous when it is desired to change colors of the coating material inasmuch as no mixing of the colors can occure because of the through-flow design.

The invention may be utilized in other forms without departing from the spirit thereof, the scope of the invention being indicated by the claims rather than by the described preferred embodiment.

I claim:

1. A device for controlling the output pressure of a pump or the like, said device comprising: an output line for transmitting fluid under pressure from said pump; said output line including a control hose portion; a plunger urged into engagement with said control hose portion by resilient biasing means for deforming said control hose portion into a predetermined configuration inconsistent with the configuration the control hose portion would assume when subjected to a predetermined variation in internal pressure; said control hose portion being movable between said configurations responsive to variations in the pressure of the fluid in the line; means responsive to the movement of said control hose portion for controlling the pump; and means for adjusting the force of said biasing means.

2. The device of claim 1, including a lever engageable by said plunger and movable therewith, said lever being operatively engageable with said controlling means so that movement of said plunger is transmitted thereto through said lever.

3. The device of claim 2, wherein said lever is pivotable about one end and has its free end engageable with said controlling means, said lever being restrained between said spring and plunger head so that movement of said plunger head is transmitted through said lever to said controlling means.

4. The device of claim 3, wherein said controlling means comprises a switch.

5. The device of claim 1, wherein said plunger comprises an arcuately convex head in engagement with said control hose; a spring urging said plunger head against said control hose; and means for adjusting the force exerted on said plunger.

* * * * *